United States Patent [19]

Kimmel et al.

[11] 4,409,582

[45] Oct. 11, 1983

[54] ELECTRICAL FUSE AND METHOD OF MAKING SAME

[75] Inventors: David J. Kimmel, Clearwater; John H. F. Lauterbach, New Port Richey, both of Fla.

[73] Assignee: AMP Incorporated, Harrisburg, Pa.

[21] Appl. No.: 384,358

[22] Filed: Jun. 2, 1982

[51] Int. Cl.[3] ..... H01H 85/16

[52] U.S. Cl. ..... 337/231; 337/295

[58] Field of Search ..... 337/231, 198, 201, 251, 337/252, 253, 260, 262, 263, 264, 295, 297; 29/623

[56] References Cited

U.S. PATENT DOCUMENTS

| | | | |
|---|---|---|---|
| 3,436,711 | 4/1969 | Borzoni | 337/198 |
| 3,909,767 | 9/1975 | Williamson et al. | 337/264 |
| 4,131,869 | 12/1978 | Schmidt et al. | 337/295 X |
| 4,203,200 | 5/1980 | Wiebe | 29/623 |
| 4,349,804 | 9/1982 | Gaia | 337/198 |

*Primary Examiner*—George Harris

*Attorney, Agent, or Firm*—Frederick W. Raring

[57] ABSTRACT

Electrical fuse comprises an insulating body having a pair of coplanar blades extending from one end thereof. The blades have portions which are supported in the body and a fuse metal link is contained in the insulating body and extends between the supported portions. The conductors which comprise the blades and the supported portions of the blades are produced by die casting and the fuse metal link is insert die cast in these conductors. The insulating body is molded onto the conductors.

12 Claims, 9 Drawing Figures

Fig. 1
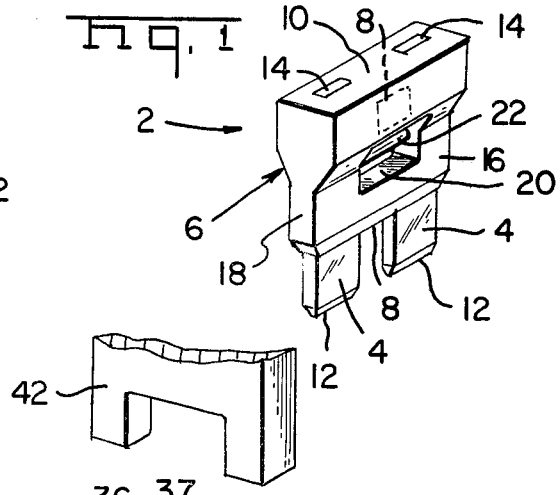
Fig. 2
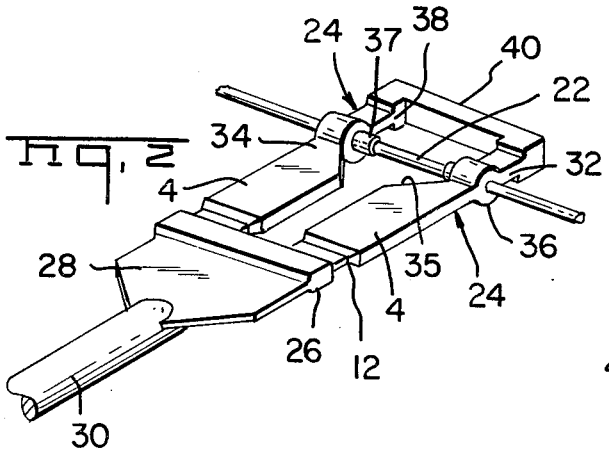
Fig. 3
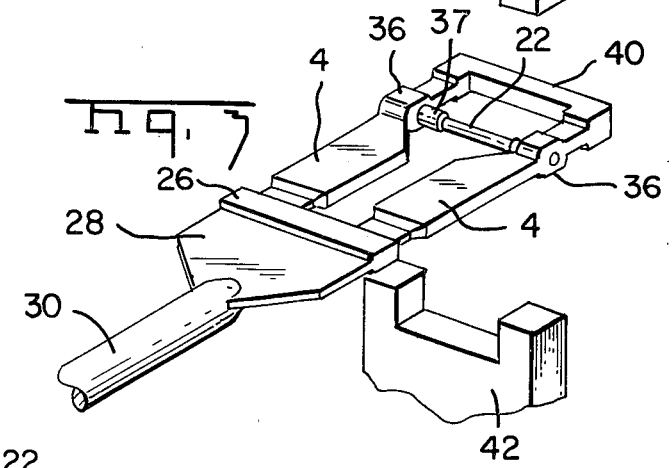
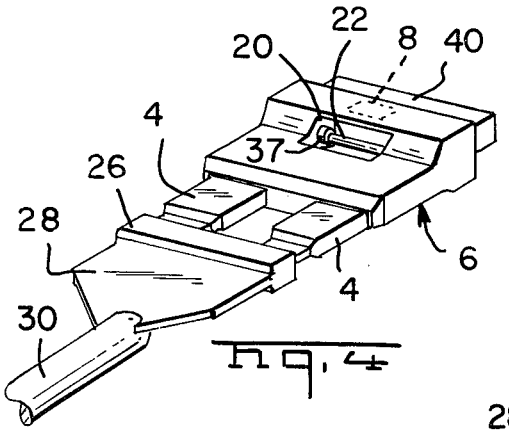
Fig. 4
Fig. 5
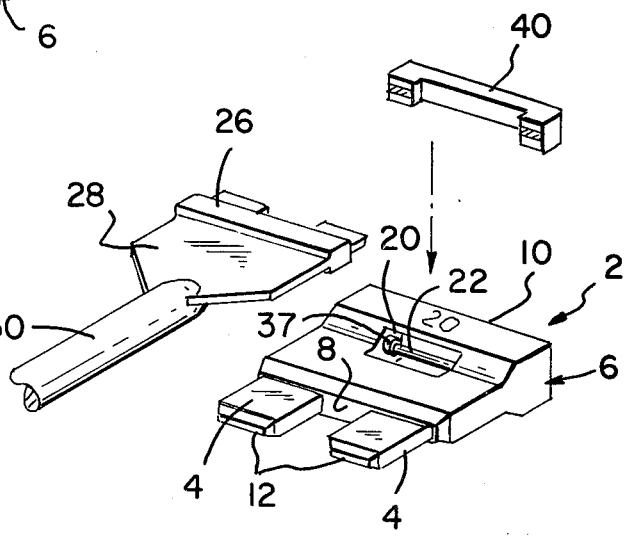

52
60
10
20
8
32
36
76
22
76
76
22
36
35
35
34
16
18
16
24
16
6
18
24
8
24
8
4
4
4
12
12
12
58
56
58
56
8

ELECTRICAL FUSE AND METHOD OF MAKING SAME

FIELD OF THE INVENTION

This invention relates to electrical fuses of the type comprising spaced-apart blades which extend from an insulating body and a fuse metal link which extends between extensions of the blades which are contained in the insulating body.

BACKGROUND OF THE INVENTION

It is becoming common practice to use a type of fuse for motor vehicle electrical systems which comprises spaced-apart parallel coplanar blades that extend from one end of an insulating body. The blades have extensions which are supported in the insulating body and the fuse metal link extends between these extensions.

The specifications for fuses of the type described above concern only the dimensions of the fuse and its electrical characteristics. The specifications permit the manufacture of such fuses by different manufacturing methods. At present, most fuses of the type under consideration are produced by stamping and forming flat sheet metal, the fuse metal link being integral with the blades and the extensions of the blades. The insulating bodies of presently used fuses are separately molded and the metallic parts of the fuse and the body are designed such that the metallic parts can be assembled to the insulating body after the two separate parts are produced.

There have been some problems in the manufacture of fuses of the type described above with regard to controlling the amperage at which the fuseable link will melt or fail, resulting in difficulties in maintaining the tolerance limits for the fuses. When the fuse metal link is produced as part of the blades and the blade extensions, it is necessary carefully to control the cross-sectional dimensions and the length of the link thereby to control the rating of the fuse and it has been found to be difficult to maintain precise control of the rating in the stamping and forming operations. The present invention is directed to the achievement of a fuse of simplified construction and which can be manufactured in a way such that precise quality control can be maintained. The invention if further directed to the achievement of a manufacturing method for a fuse which will avoid the necessity of assembling the metallic parts of the fuse to a molded housing.

An electrical fuse in accordance with the invention comprises a pair of parallel spaced-apart conductors, each of the conductors having a supported portion and a flat blade portion. The supported portions are supported in an insulating body with the blade portions extending from one end of the insulating body. A fuse metal link has its ends connected to the supported portions and is at least partially contained in the insulating body. A fuse in accordance with the invention is particularly characterized in that the spaced-apart conductors are of die cast metal and the insulating body is molded on the spaced-apart conductors.

In accordance with further embodiments, the fuse metal link is contained in the supported portions of the conductors and the conductors are die cast onto the fuse metal link. In accordance with a further embodiment, the supported portions of the conductors are crimped onto the ends of the fuse metal link and the insulating body has an opening extending therethrough and through which the fuse metal link extends so that it is exposed.

In accordance with a further aspect of the invention, a method of producing fuses as described above is particularly characterized in that the fuse metal link is positioned in the die casting die having side-by-side mold cavities which, when filled, will produce the spaced-apart conductors of the fuse. The fuse metal link is located in the die with its ends disposed in the portions of the cavities which produce the supported portions of the conductors and with an intermediate portion of the fuse metal link extending between the cavities. The method is characterized by the further steps of injecting die castable metal into the die cavities and thereafter removing the die cast conductors from the die with the fuseable link extending between the conductors. The insulating body is thereafter molded onto the supported portions of the conductors.

DESCRIPTION OF THE DRAWINGS

FIG. 1 is a persective view of a fuse in accordance with the invention.

FIGS. 2–5 are a series of perspective views illustrating die cast conductors as removed from the die (FIG. 2), the clinching or crimping of the conductors onto the fuse metal link (FIG. 3), the molding of the body onto the die cast conductors (FIG. 4), and the removal of the excess die cast parts from the completed fuse (FIG. 5).

PREFERRED EMBODIMENT OF THE INVENTION

Figure 6:
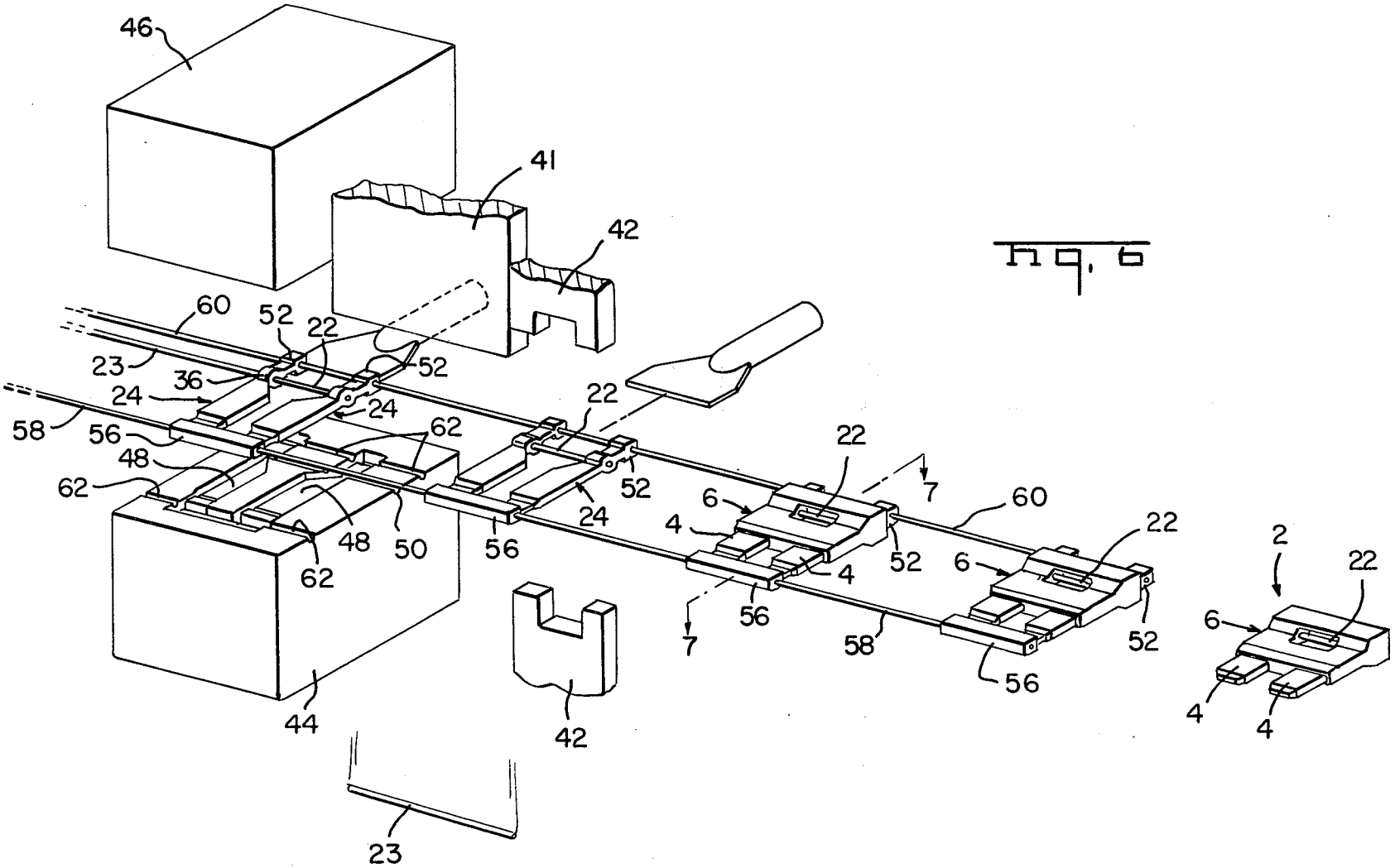
FIG. 6 is a perspective view illustrating the manufacture of fuses in strip form in a continuous manufacturing process.

A fuse 2 in accordance with the invention, FIG. 1, comprises a pair of spaced-apart coplanar blades 4 which extend from one end 8 of a molded plastic body 6. The blades are parts of conductors which extend into the body and the upper ends 14 of these conductors are exposed on the upper end 10 of the body for probing purposes.

The plastic body has oppositely facing sidewalls 16 which are tapered as shown and oppositely facing endwalls 18. An opening 20 extends through the body and a fuse metal link 22 is exposed in this opening. The fuse metal link is connected to the conductors embedded in the plastic body as described below.

FIGS. 2–5 show the essential steps which are followed in producing fuses as shown in FIG. 1 with relatively simple tooling, including a single cavity die in a die casting machine. As shown in FIG. 2, the spaced-apart conductors 24 are produced by die casting, these conductors including the blades 4, and upper portions 32 which are supported in the insulating body after molding. In the embodiment of FIG. 2, the die cast metal was introduced into the die cavity through a gate communicating with the free ends 12 of the blades. When the die casting is removed from the die, a block of die cast metal 26 is integral with these free ends and is integral also through a transition section 28 which in turn is integral with solidified metal 30 from the sprue.

The supported portions 32 of the conductors 24 have transition sections 34 which have inclined edges 35 and which merge with relatively thick sections 35 of reduced width. The ends 38 of the conductors 24 are connected by a section 40 of die cast metal which is provided to permit the flow of the die casting metal through the cavity and which permits venting of the die cavities. The fuse metal link 22 extends through the thick sections 36 of the conductors and the die cast metal is integrally cast onto the ends of this fuse metal link. The thick sections 36 have integral projections 37 on their opposed surfaces for reasons that are discussed below.

As shown in FIG. 3, it is sometimes desirable to clinch or crimp the enlarged thick sections 36 of the conductors by means of crimping tooling shown at 42. In this operation, the thick sections 36 are simply compressed and caused to flow relative to the ends of tis fuse metal link in order to ensure good electrical contact and secure mechanical connections between the fuse metal and the die cast conductors. The clinching or crimping operation may not always be necessary, particularly if the surface of the fuse metal is entirely free of oxide and the manufacturing conditions are carefully controlled, however, the clinching operation does provide added assurance of the quality and performance of the completed fuse of FIG. 5.

As shown in FIG. 4, the plastic body 6 is molded onto the conductors 24, a core pin being provided in the mold parts to leave the opening 20 in the body. This molding operation is essentially an insert molding operation of the type in which metal parts are placed in the mold cavity and the molding material is cast onto the metal parts. The plastic body may be of any suitable plastic material, a thermoplastic polyester material being ideally suited in view of its cost and the ease with which it can be injection molded.

After the molding operation, the sprue and adjacent scrap parts 28, 26 and the connecting section 40 are removed from the fuse leaving the completed fuse as shown. These parts are removed by a simple severing operation.

The conductors 4, 24 may be die cast of any suitable die casting material. Good results have been obtained with zinc alloys, particularly a die casting zinc alloy containing 95% zinc, 4½% aluminum, and the balance essentially copper. The fuse metal link 22 is preferably of fuseable wire which is obtainable in carefully controlled diameters which determine the electrical characteristics of the finished fuse.

FIG. 6 illustrates the manner in which fuses in accordance with the invention can be produced in a continuous process. In this view, the dies 46, 44 are provided with cavities 48, which when filled, will produce the spaced-apart conductors 24. Recesses 50 are provided in the lower die 44 for the fuse metal link 22 which in this instance is a section of a continuous wire 23 of fuse metal. The cavities are gated at the ends 52, the scrap produced by the gate being shown at 54. This scrap may be removed at the time the fuse wire portions 23 are removed as described below. The gate may be provided in the die section 46 and is therefore not shown in FIG. 6.

In order to facilitate the manufacturing process, the conductors 24 for each fuse are die cast onto two carrier wires 58, 60 which are accomodated in recesses 62 on the upper surface of the lower die 44. In the completed die castings, the wire 58 extends through the connecting section 56 of the die casting and the carrier wire 60 extends through the enlarged ends 52 of the conductors. The wires 58, 60 may be of steel, since they perform no electrical function but merely serve to carry the die castings and completed fuses past subsequent process stations.

The thick sections 36 of the die castings are crimped or clinched as described above by crimping tools 42. At the same time, the fuse wire 23 is severed from the outside edges of the conductors by severing tooling 41 which may be provided with the crimping tooling.

The continuous strip of die castings is then fed through an injection molding station in which the thermoplastic molding material is molded onto the die castings. After the molding operation, the sections 52 and 56 are trimmed from the individual fuses to produce loose piece fuses 2.

As an alternative, the continuous strip of completed fuses can remain in strip form and be fed to an assembly machine in which they would be inserted into a junction box or the like. Under such circumstances, the trimming operations would be carried out by the assembly machine.

Fuses in accordance with the invention can be serially produced by manufacturing methods which may be almost entirely automatic and which require little or no human intervention or attention. The wires 58, 60 can be intermittently fed from the die casting station to the crimping station and then to the thermoplastic molding section to produce the continuous strip shown in FIG. 6. The assembly operation of assembling the metallic parts of the fuse to a housing as required by prior art fuses, is entirely avoided.

Figures 7, 8:
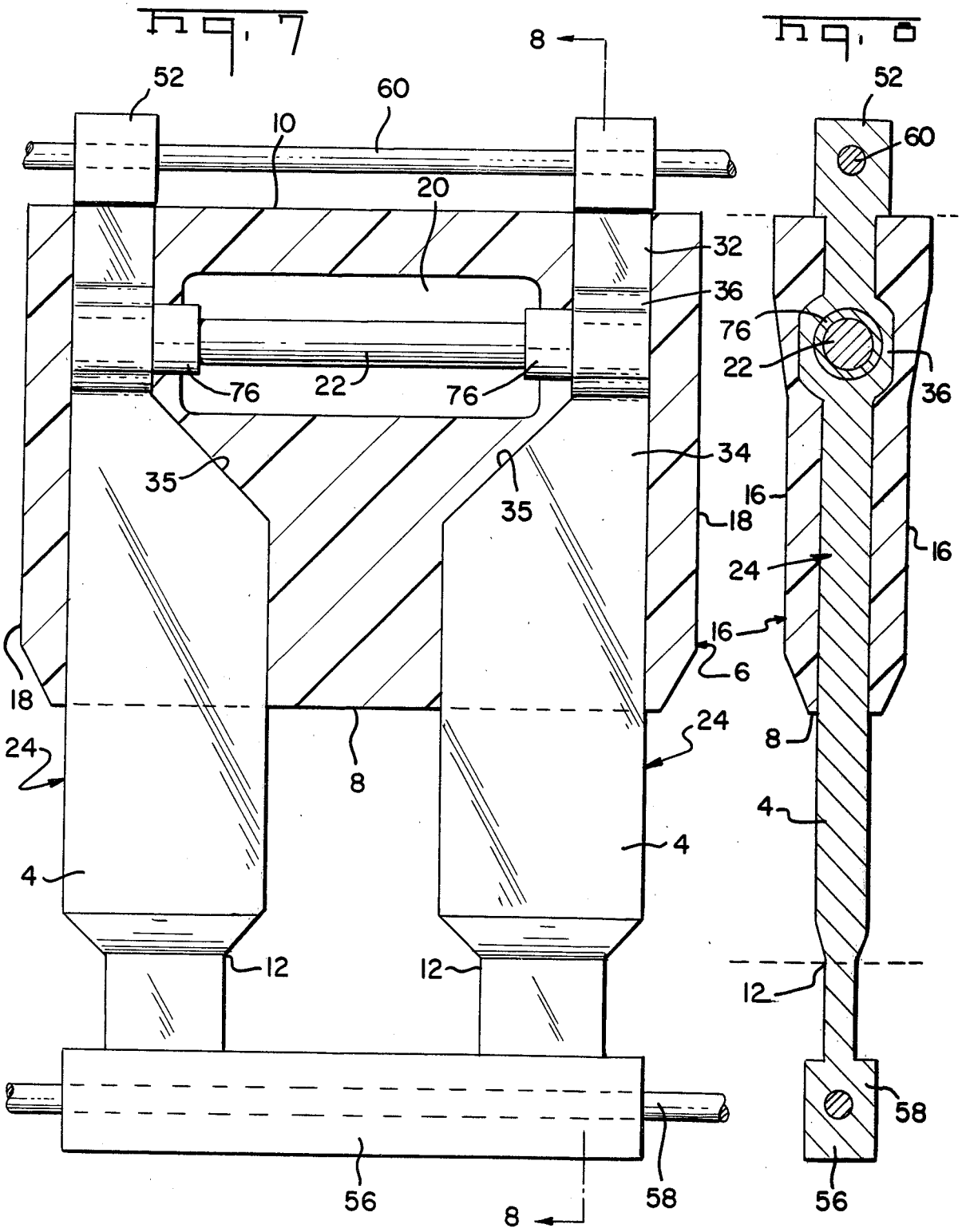
FIG. 7 is a plan view partially in section, of a completed fuse prior to removal of the fuse from the carrier members.
FIG. 8 is a view taken along the lines 8—8 of FIG. 7.

Fuses in accordance with the invention can be made with any desired amperage rating by merely selecting the fuse wire 23 such that is current-carrying capacity will produce the desired rating. In this respect, the bosses 37 are a highly advantageous feature in that a single injection mold can be used for fuses of all amperage ratings. The diameter of the fuse wire 22 will be different for fuses of different amperage ratings. However, and as shown in FIG. 7, the molding material which forms the body 6 is molded onto the bosses 37 and not the wire 22. It follows that the diameter of the wire need not be considered when the mold for injection molding of the body 6 is designed.

A highly advantageous feature of the fuse in accordance with the invention is that the electrical characteristics of the fuse can be closely controlled by making minor changes to the fuse and the manufacturing machinery. For example, if it is desired to raise the amperage at which the fuse will blow or fail, the size of the opening 20 can be increased so that a greater amount of surface of the wire 22 will be exposed and a greater cooling effect will be achieved. Alternatively, the mass of metal in the relatively thick sections 36 of the die cast conductors 24 can be increased, thereby increasing the heat sink characteristics of the conductors relative to the wire. Minor changes of this type can be made precisely to control the electrical characteristics of the fuse. Fuses of different ratings will, of course, be made with different wire diameters and changes to the size of the opening 20 or the mass or metal at 36 in the die castings would be made to achieve precise characteristics in the fuse.

The blades 4 of the individual fuses can be plated, if desired, with a metal having good contact properties and corrosion resistance. A suitable plating for zinc alloy fuses is tin with an underplating of copper. Plating operations can be carried out while the fuses are in continuous strip form and the carrier wires 58 used as conductors during the process.

What is claimed is:

1. An electrical fuse of the type comprising a pair of parallel spaced-apart conductors, each of the conductors having a supported portion and a flat blade portion, the supported portions being supported in an insulating body, the blade portions extending from one end of the insulating body, and a fuse metal link having its ends connected to the supported portions and being at least partially continued in the insulating body, the fuse being characterized in that:

the spaced-apart conductors are of die cast metal and the insulating body is molded onto the spaced-apart conductors.

2. An electrical fuse as set forth in claim 1 characterized in that the fuse metal link is contained in the supported portions of the conductors, the conductors being die cast onto the fuse metal link.

3. An electrical fuse as set forth in claim 2 characterized in that the supported portions of the conductors are crimped onto the ends of the fuse metal link.

4. An electrical fuse as set forth in either of claims 2 or 3 characterized in that the insulating body has a second end which is oppositely facing with respect to one end, the supported portions of the conductors extending to the second end and being exposed on the second end thereby to provide probe points for the fuse.

5. An electrical fuse as set forth in either of claims 2 or 3 characterized in that the insulating body has a second end which faces oppositely with respect to the first end, the insulating body having spaced-apart sidewalls extending between the one end and the second end, the fuse metal link being between the planes of the sidewalls, an opening extending through the insulating body and between the sidewalls, an intermediate portion of the fuse metal link being exposed in the opening.

6. An electrical fuse as set forth in claim 5 characterized in that the supported portions of the conductors have integral die cast projections which extend towards each other and into the opening, the fuse metal link extending through, and being supported in, the projections.

7. An electrical fuse as set forth in claim 5, the die cast conductors being of zinc and being electroplated with tin.

8. An electrical fuse as set forth in either of claims 2 or 3 characterized in that at least one pair of corresponding ends of the spaced-apart conductors are removably integral with a continuous carrier member, the carrier member having a plurality of identical fuses integral therewith at spaced-apart intervals.

9. An electrical fuse as set forth in claim 8 characterized in that the remaining pair of corresponding ends are integral with a second continuous carrier member.

10. An electrical fuse as set forth in claim 9 characterized in that the carrier members are wire, both ends of each conductor having integral removable die cast extensions, the wires extending through the extensions.

11. A method of making an electrical fuse of the type comprising a pair of parallel spaced-apart conductors, each of the conductors having a supported portion and a flat blade portion, the supported portions being supported in an insulating body, the blade portions extending from one end of the insulating body, and a fuse metal link having its ends connected to the supported portions and being at least partially contained in the insulating body, the method being characterized by the steps of:

positioning the fuse metal link in a die casting die having side-by-side die cavities which, when filled, will produce the spaced-apart conductors, the fuse metal link being located with its ends disposed in the portions of the cavities which produce the supported portions of the conductors, and intermediate portion of the fuse metal link extending between the cavities, injecting die castable metal into the die cavities and thereafter removing the die cast conductors from the die with the fuseable element extending between the conductors, and molding the insulating body on the supported portions of the conductors.

12. The method set forth in claim 11 characterized in that the fuse link which is located in the mold is an intermediate portion of an elongated section of fuse conductor and the fuse conductor is repetitively fed to the die and fuse conductors are repetitively cast onto the elongated section of fuse conductor.

* * * * *